US006325077B1

(12) United States Patent
Lark

(10) Patent No.: US 6,325,077 B1
(45) Date of Patent: Dec. 4, 2001

(54) CONTACT LENS KIT AND CARRYING POUCH

(76) Inventor: Diane Lark, 23811 E. Goldrush Dr., Diamond Bar, CA (US) 91765

( * ) Notice: Subject to any disclaimer, the term of this patent is extended or adjusted under 35 U.S.C. 154(b) by 0 days.

(21) Appl. No.: 09/483,827

(22) Filed: Jan. 15, 2000

Related U.S. Application Data

(60) Provisional application No. 60/116,285, filed on Jan. 19, 1999.

(51) Int. Cl.[7] ..... A45D 40/18

(52) U.S. Cl. ..... 132/312; 132/316; 132/314; 206/581

(58) Field of Search ..... 132/294, 295, 132/301, 312, 314, 315, 297; 206/376, 377, 553, 581, 5.1, 569, 539, 38, 530

(56) References Cited

U.S. PATENT DOCUMENTS 1,578,778 * 3/1926 Thornhill ..... 132/312
1,722,507 * 7/1929 Stanley ..... 132/312
2,042,584 * 6/1936 Bustamante ..... 132/312
2,140,036 * 12/1938 Morrison ..... 132/312
4,951,811 * 8/1990 Lines ..... 206/581
5,713,381 * 2/1998 Sloane ..... 132/312

* cited by examiner

*Primary Examiner*—Pedro Philogene
(74) *Attorney, Agent, or Firm*—Roger A. Marrs

(57) ABSTRACT

A contact lens kit or pouch organizer for removably storing a plurality of accessories which are contained in separate containers such as lens solutions, contact lens themselves, a drain catcher and a mirror. The organizer includes a box-like container properly sized to accommodate the shape and size of the contact lens accessories intended to be placed therein. A container closure includes an upper flap intended to fold over an opening leading into the interior of a storage compartment and which closes with a snap fastener on a bottom flap which folds across the bottom of the container and folds upwardly to receive the snap fastener on the upper flap. A mirror carried on the external surface of the container is covered by the bottom flap or the mirror can be mounted on the inside of the bottom flap so as to bear against the outside of the container when the bottom flap is folded. The storage compartment is divided by partitions so that individual receptacles are defined for receiving specific articles selected from the contact lens accessories. A drain catcher disk is included for storage so that upon removal, the disk can be placed over the drain in the sink to prevent the loss of a lens through the plumbing system.

5 Claims, 3 Drawing Sheets

FIG. 4
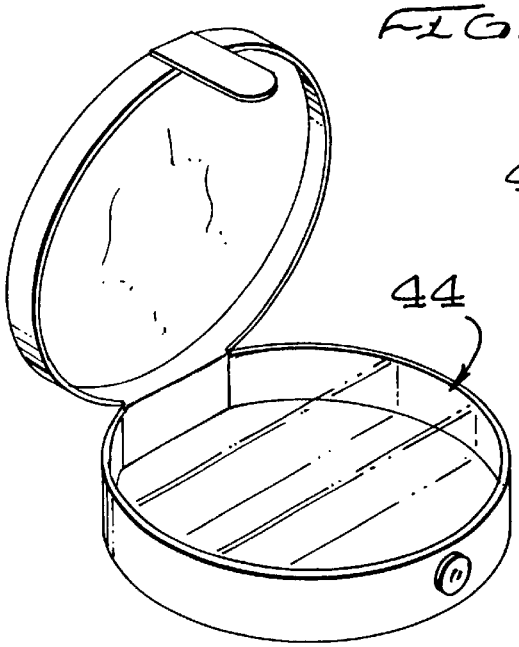
FIG. 5
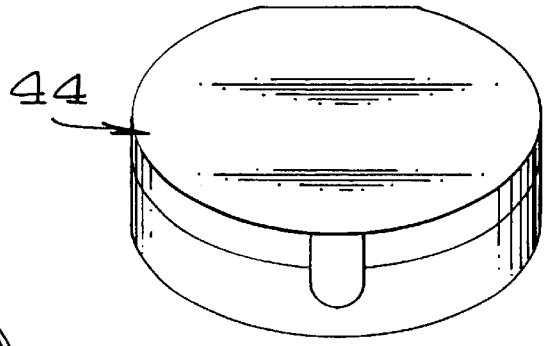
FIG. 6
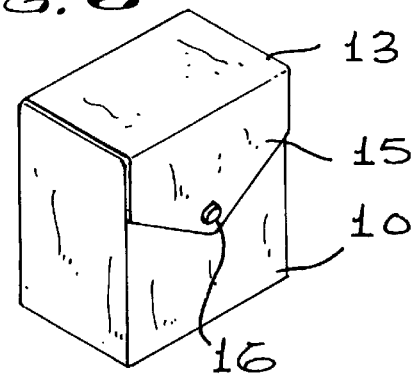
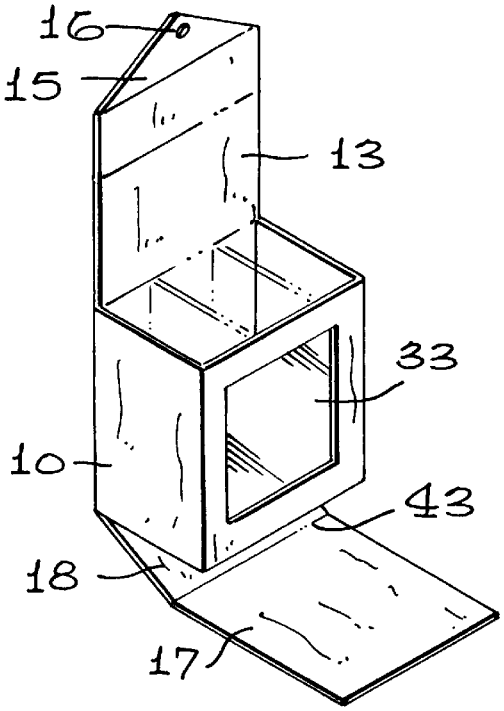
FIG. 7
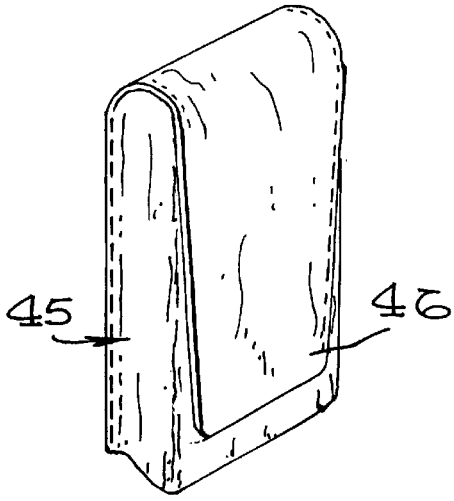
FIG. 8

CONTACT LENS KIT AND CARRYING POUCH

Priority claimed on Ser. No. 60/116,285 filed Jan. 19, 1999.

BACKGROUND OF THE INVENTION

1. Field of the Invention

The present invention relates to the field of contact lens accessories and more particularly to a novel carrying pouch for holding a variety of contact lens accessories such as lens solutions, cleaning solutions, lens holders or the like which may be stored in the pouch along with a mirror and flap closures.

2. Brief Description of the Prior Art

In the past, it has been the conventional practice to store contact lens accessories into a box having a lift-off lid. The box has an interior storage compartment which is not partitioned and the contact accessories are placed in the box in a random manner. The separate containers for such items as liquid solution, contact lenses themselves and other holders are not of a uniform shape and size and therefore randomly placing the accessories into the storage compartment of the box provides a cluttered and unorganized appearance. Also, such disorganization does not assist the user in locating and selecting a desired accessory at the time of use. Also, no provision is made for assisting the user in either installing the contact lens or in removal of the lens and no provision is made for preventing a lens from falling into the drain of a sink while a lens is being manipulated for insertion or removal.

Therefore, a long standing need has existed to provide a pouch or kit for contact lens accessories that will readily assist the user during the procedure of installation or removal of the lens, such as by incorporating a mirror and a drain catch disk into a pouch assembly so that the accessory items can be stored in an organized manner. The pouch should have proper closures so that the user can readily gain access to the storage compartment and the mirror and drain catcher must be accommodated so that not to interfere with the organization of the contact lens components or accessories within the pouch.

SUMMARY OF THE INVENTION

Accordingly, the above problems and difficulties are avoided by the present invention which provides a novel contact lens kit or pouch organizer for accommodating the storage of a plurality of accessories in separate containers such as lens solutions, contact lenses themselves, a drain catcher and a mirror. The accessory organizer takes the form of a pouch having a box-like container properly sized to accommodate the shape and size of the contact lens accessories intended to be placed therein. A pouch closure means takes the form of an upper flap intended to fold over an opening leading into the interior of a storage compartment and which closes with a snap fastener with a bottom flap that folds across the bottom of the container and folds upwardly to receive the snap fastener on the upper flap. A mirror carried on the external surface of the container is covered by the lower flap or the mirror can be mounted on the inside of the bottom flap so as to bear against the outside of the container when the bottom flap is folded. In other forms of the invention, the shape or configuration may be circular, square, rectangular and, preferably, the storage compartment divided by a system of partitions so that individual receptacles are defined for receiving specific articles selected from the contact lens accessories. A drain catcher disk is included for storage in the storage compartment so that upon removal, the drain catcher disk can be placed over the drain in the sink to prevent the loss of a lens through the plumbing system.

Therefore, it is among the primary objects of the present invention to provide a novel lens kit and pouch organizer for removably storing and holding accessories such as contact lens solution bottles, cleansing solution bottles, drain stop or catcher means and contact lens holders so that the accessories are arranged in an organized manner for user visual selection and removal.

Another object of the present invention is to provide a novel contact lens kit or pouch which includes means for assisting the user during the procedure of installation or removal of lenses which may include a mirror and/or a drain stop or catch.

Another object of the present invention is to provide a novel contact lens accessory organizer which includes a central storage compartment, having flaps which not only close the entrance leading into the compartment but which folds about the container so as to include or protect a mirror useful in the procedure of installing or removal of contact lenses.

A further object resides in having a see through pouch with a mirror on a foldable flap such that the interior of the pouch can be seen and the contents identified without opening the pouch flaps.

A further objects resides in providing a contact lens pouch having a mirror on the inside of a flap with an eyelet and carrying hook for attachment to a carrying strap or the like.

Yet another object resides in providing a novel contact lens accessory pouch which will readily accommodate at least three bottles in a storage compartment, a cleaning cloth and a set of contact lens in a holder, whereby the items are organized in a particular manner so as to assist the user in locating and removal of the items.

A feature further resides in providing a flexible drainage block disk or drain catch disk that catches a contact lens that may inadvertently drop into a sink or basin.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIGS. 4 and 5 are perspective views of another version of the invention;

FIGS. 6 and 7 are perspective views of the version shown in FIG. 2;

FIGS. 8 and 9 are perspective views of additional views; and

DESCRIPTION OF THE PREFERRED EMBODIMENT

Figure 1:
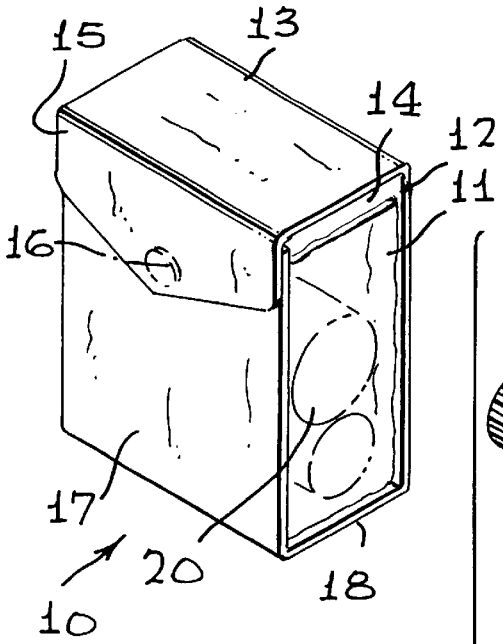
FIG. 1 is a front perspective view of a contact lens carrying case or pouch incorporating the present invention.

Referring to FIG. 1, the novel contact lens kit and organizer is illustrated in the general direction of arrow 10 which includes a container 11 for holding a plurality of contact lens accessories and items. The container 11 is attached to a supporting closure means which includes a rigid back 12 having a foldable top 13, which traverses an opening 14 leading into the storage compartment of the container 11. The folding top 13 terminates in a flap 15 which is maintained in a closed position by means of a snap fastener 16, having components on the underside of flap 15 and on a front flap 17. The front flap 17 is integral with back 12 and extends around the bottom of the container 11 by means of a segment 18. In one form of the invention, the container 11 is composed of a transparent or translucent material so that the items contained within the storage compartment are visible externally of the container. One such item is viewed through the material of the container and is identified by numeral 20.

Figure 2:
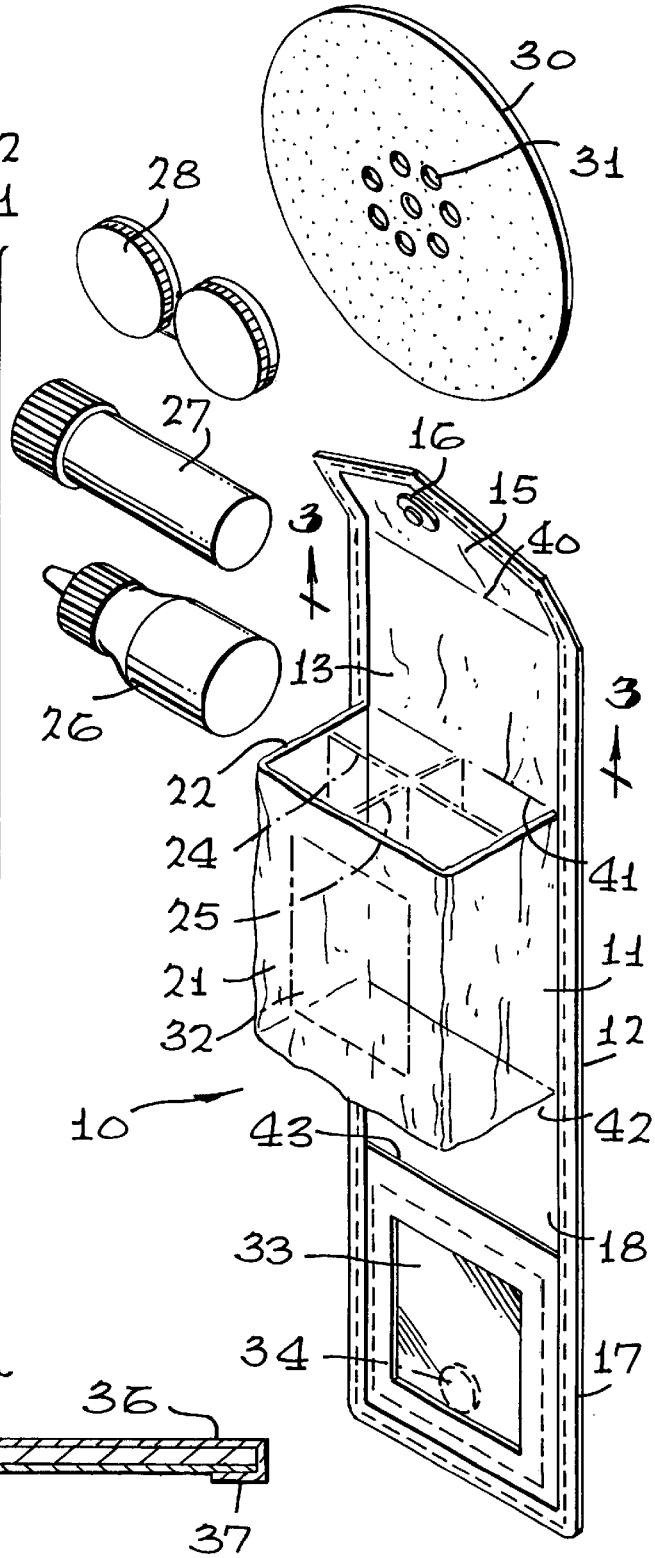
FIG. 2 is an exploded perspective view of the pouch shown in FIG. 1 illustrated in an open condition and further illustrating the contact lens accessory contents to be organized and stored in the storage compartment of the container.

Referring now in detail to FIG. 2, it can be seen that the container 11 includes a front section 21 as well as sides 22 and 23, which internally define a storage compartment that may include partitions running normal to one another such as identified by numerals 24 and 25. The partitions serve to define individual, specialized receptacles into which contact lens items or accessories can be insertably stored. For example, the receptacles may readily receive a cleansing solution bottle 26, a contact lens accessory solution 27, and a contact lens holder 28. Furthermore, a drain strainer or contact lens catch is indicated by numeral 30 and may be composed of a flexible material so that it can be folded and stored within a receptacle in the container 11. The strainer includes a plurality of openings within a central location indicated by opening or apperature 31 and the disk 30 may be placed over a drain in the sink, permitting water to flow through the openings. However, the openings are smaller than the diameter contact lenses so that should user drop a lens into the sink during the procedure of installation or removal, the catch or strainer 30 will hold the dropped lens for subsequent retrieval by the user. Therefore, the strainer prevents the lens from entering the plumbing system.

It is to be noted that a feature resides in providing the container with sides and front panel 21 composed of translucent and transparent material so that the user can readily identify items that are stored in the respective receptacles of the storage compartment. Also, the front panel 21 may support a mirror identified by numeral 32 which the user may use during the installation or removal procedures. Additionally, if desired, the mirror 32 can be placed on the inside of the bottom or front flap 17 and such installation is indicated by numeral 33. The front side of the front flap 17 includes a fastening component 34 used in connection with the snap component 16 for releasable closure.

Figure 3:
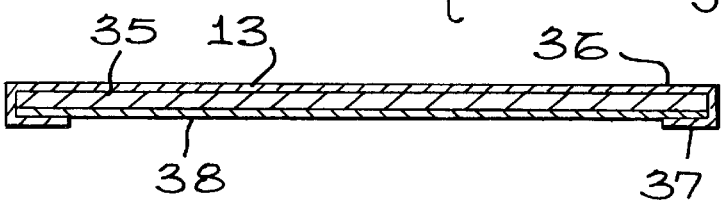
FIG. 3 is an enlarged transverse cross-sectional view of the flap of the container shown in FIG. 2 taken in the direction of the arrows 3—3 thereof.

Referring to FIGS. 2 and 3, it can be seen that the entire length of the back 12 including both upper flap 13, flap 15 and bottom or lower flaps 17 and 18 are integrally formed as a unitary construction with an elongated rigid member such as cardboard 35 covered by a leather or leatherette covering 36. Reinforcement is provided by an edge marginal strip 37 that is continuous and follows the inner surface edge of the back and flaps. An inner layer of leather or leatherette 38 completes the member 35 covering.

Fold or scored lines 40, 41, 42 and 43 permit the flaps to bend about the container 11 to assume the configuration shown in FIG. 1.

FIGS. 4–11 inclusive illustrate different configurations embodying the present invention in addition to the embodiment shown in FIGS. 1–3 inclusive.

Figure 9:
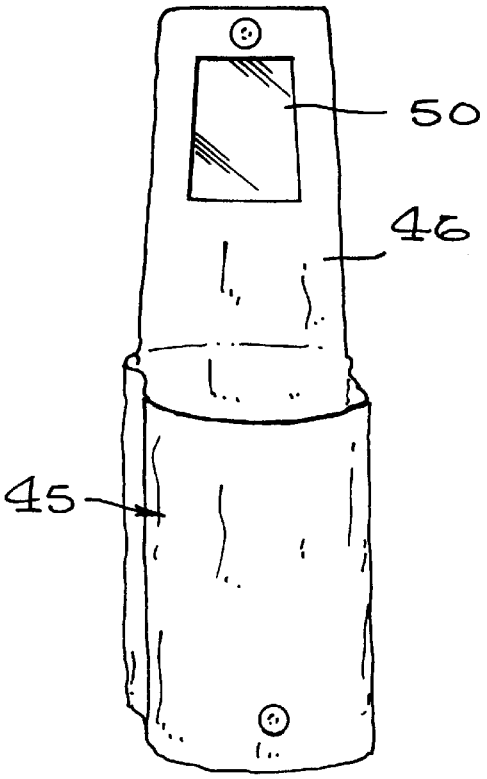
Figure 10:
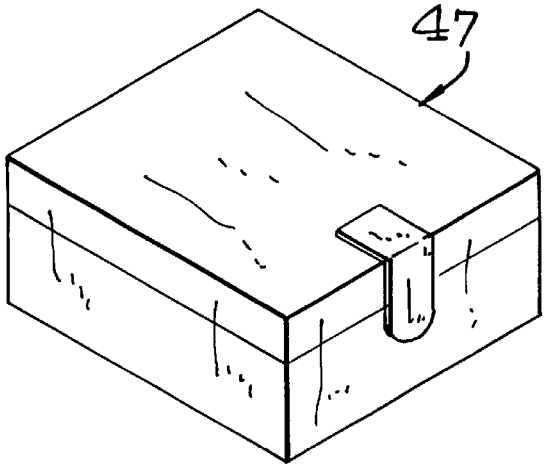
FIGS. 10 and 11 are perspective views of still another embodiment of the invention.
Figure 11:
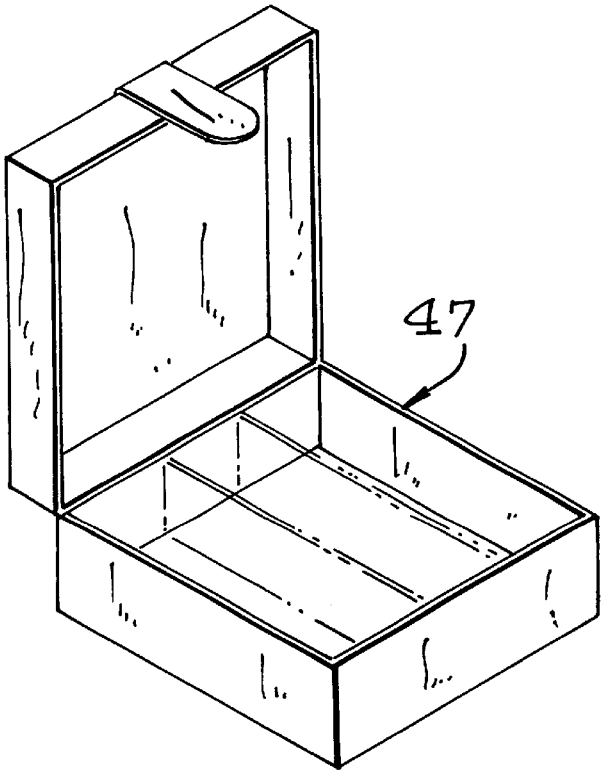

FIGS. 4 and 5 show a semi-circular shape 44 while FIGS. 6 and 7 are similar to the shape 10 shown in FIGS. 1–3. FIGS. 8 and 9 illustrate a soft container 45 having a single flap 46 with a mirror 50 on the inside thereof. FIGS. 10 and 11 illustrate a box-like container 47 with individual storage compartments. All of the above noted containers have pivotal or hinged flaps that cover and close the internal storage compartment.

Therefore, it can be understood that a container is provided for organizing the arrangement and placement of contact lens items in a selected orientation. The container and the items constitute a kit and the mirror may be placed in any one of a number of places on either the wall of the container per se or on a lid or flap. The container may be transparent or opaque as shown in FIG. 2. The internal storage compartment may have installed partitions or an insert of partitions may be employed.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A combination contact lens kit and carrying pouch comprising:

a variety of contact lens accessories;

a carrying pouch for said variety of contact lens accessories including a container;

said container having rigid walls defining a box with an open top leading into an open internal storage compartment;

closure means carried on said pouch for selectively closing said internal storage compartment of said container which includes an elongated back member attached to said container and having an extended bottom portion and an extended upper portion, both of said portions extending beyond said container with said upper portion adapted to close said internal storage compartment;

said upper and said lower portions constituting flaps terminating in free ends and adapted to fold about said container to close said internal storage compartment;

said variety of contact lens accessories selected from the group consisting of contact lens solution, cleaning solutions, lens holders, and drain block;

a mirror secured to a selected wall of said container adapted to be covered by said extended bottom portion;

said container having non-selected walls of transparent or translucent composition permitting visual identification of said contact lens accessories in said internal storage compartment; and said drain block is a disk of flexible material and having a plurality of openings therein, each of said openings of less diameter than the diameter of a contact lens.

2. The combination contact lens kit and carrying pouch as defined in claim 1 wherein:

said upper portion of said back member includes a foldable top terminating in a flap;

said bottom portion includes a front flap and a segment; and a fastener means detachably connecting said upper portion flap with said bottom portion front flap.

3. The combination contact lens kit and carrying pouch defined in claim 1 wherein:

said walls are four rigid panels arranged in a continuous side-to-side relationship so that said internal storage compartment is defined by at least four internal opposing surfaces of said rigid walls.

4. The combination contact lens kit and carrying pouch defined in claim 1 including:

at least two partitions disposed in said internal storage compartment and arranged perpendicular with respect to each other.

5. The combination contact lens kit and carrying pouch as defined in claim 1 wherein:

said back member includes a plurality of fold lines separating said portions and said flaps whereby said back member is adapted to be wrapped about said pouch to close said storage compartment.

* * * * *